US006188036B1

(12) United States Patent
Arnold

(10) Patent No.: US 6,188,036 B1
(45) Date of Patent: Feb. 13, 2001

(54) BOTTOM VENTED CIRCUIT BREAKER CAPABLE OF TOP DOWN ASSEMBLY ONTO EQUIPMENT

(75) Inventor: David Arnold, Chester, CT (US)

(73) Assignee: General Electric Company, Schenetady, NY (US)

( * ) Notice: Under 35 U.S.C. 154(b), the term of this patent shall be extended for 0 days.

(21) Appl. No.: 09/366,473

(22) Filed: Aug. 3, 1999

(51) Int. Cl.[7] ..... H01H 33/02

(52) U.S. Cl. ..... 218/157; 335/8; 335/202; 218/35

(58) Field of Search ..... 335/8–10, 132, 335/201, 202, 16, 147, 195; 200/293–308; 218/34, 35, 149, 152, 155, 156, 157

(56) References Cited

U.S. PATENT DOCUMENTS

D. 367,265 2/1996 Yamagata et al. .
2,340,682 2/1944 Powell .

(List continued on next page.)

FOREIGN PATENT DOCUMENTS 819 008 12/1974 (BE) .
12 27 978 11/1966 (DE) .

(List continued on next page.)

*Primary Examiner*—Lincoln Donovan
(74) *Attorney, Agent, or Firm*—Cantor Colburn LLP; Carl B. Horton

(57) ABSTRACT

A bottom vented circuit breaker capable of top-down assembly onto equipment (10) includes a plurality of breaker cassettes (12) disposed in a base (14) with a cover (16) mounted upon the base (14). Breaker cassettes (12) include breaker connection lugs (18) extending therefrom for electrically connecting to equipment connection lugs (20) extending from a protected circuit. Base (14) includes a plurality of discrete arc gas vent structures (56) extending from a bottom wall (52). Each arc gas vent structure (56) comprises a manifold portion (58) in fluid communication with duct portions (60, 62). Ducts (60, 62) extend substantially parallel to each other and outward from manifold (58) along spacers (54) or side walls (44, 46), culminating at exit ports (64, 66). The external surface (74) of ducts (60, 62) are separated by a minimum distance "A" forming access opening (21) in conjunction with side walls (44, 46) and spacers (54). Breaker assembly (10) is installed downward onto equipment connection lugs (20) and insulating pad (19), with equipment connection lugs (20) passing through access openings (21) formed in base (14).

11 Claims, 5 Drawing Sheets

U.S. PATENT DOCUMENTS

| | | | |
|---|---|---|---|
| 2,719,203 | | 9/1955 | Gelzheiser et al. . |
| 2,937,254 | | 5/1960 | Ericson . |
| 3,158,717 | | 11/1964 | Jencks et al. . |
| 3,162,739 | | 12/1964 | Klein et al. . |
| 3,197,582 | | 7/1965 | Norden . |
| 3,307,002 | | 2/1967 | Cooper . |
| 3,328,553 | * | 6/1967 | Gryctko ..... 218/156 |
| 3,517,356 | | 6/1970 | Hanafusa . |
| 3,631,369 | | 12/1971 | Menocal . |
| 3,803,455 | | 4/1974 | Willard . |
| 3,883,781 | | 5/1975 | Cotton . |
| 4,129,762 | | 12/1978 | Bruchet . |
| 4,144,513 | | 3/1979 | Shafer et al. . |
| 4,158,119 | | 6/1979 | Krakik . |
| 4,165,453 | | 8/1979 | Hennemann . |
| 4,166,988 | | 9/1979 | Ciarcia et al. . |
| 4,220,934 | | 9/1980 | Wafer et al. . |
| 4,255,732 | | 3/1981 | Wafer et al. . |
| 4,259,651 | | 3/1981 | Yamat . |
| 4,263,492 | | 4/1981 | Maier et al. . |
| 4,276,527 | | 6/1981 | Gerbert-Gaillard et al. . |
| 4,297,663 | | 10/1981 | Seymour et al. . |
| 4,301,342 | | 11/1981 | Castonguay et al. . |
| 4,360,852 | | 11/1982 | Gilmore . |
| 4,368,444 | | 1/1983 | Preuss et al. . |
| 4,375,021 | | 2/1983 | Pardini et al. . |
| 4,375,022 | | 2/1983 | Daussin et al. . |
| 4,376,270 | | 3/1983 | Staffen . |
| 4,383,146 | | 5/1983 | Bur . |
| 4,392,036 | | 7/1983 | Troebel et al. . |
| 4,393,283 | | 7/1983 | Masuda . |
| 4,401,872 | | 8/1983 | Boichot-Castagne et al. . |
| 4,409,573 | | 10/1983 | DiMarco et al. . |
| 4,435,690 | | 3/1984 | Link et al. . |
| 4,467,297 | | 8/1984 | Boichot-Castragne et al. . |
| 4,468,645 | | 8/1984 | Gerbert-Gaillard et al. . |
| 4,470,027 | | 9/1984 | Link et al. . |
| 4,479,143 | | 10/1984 | Watanabe et al. . |
| 4,488,133 | | 12/1984 | McClellan et al. . |
| 4,492,941 | | 1/1985 | Nagel . |
| 4,541,032 | | 9/1985 | Schwab . |
| 4,546,224 | | 10/1985 | Mostosi . |
| 4,550,360 | | 10/1985 | Dougherty . |
| 4,562,419 | | 12/1985 | Preuss et al. . |
| 4,589,052 | | 5/1986 | Dougherty . |
| 4,595,812 | | 6/1986 | Tamaru et al. . |
| 4,611,187 | | 9/1986 | Banfi . |
| 4,612,430 | | 9/1986 | Sloan et al. . |
| 4,616,198 | | 10/1986 | Padini . |
| 4,622,444 | | 11/1986 | Kandatsu et al. . |
| 4,631,376 | | 12/1986 | Leone . |
| 4,631,625 | | 12/1986 | Alexander et al. . |
| 4,639,564 | | 1/1987 | Grunert et al. . |
| 4,642,431 | | 2/1987 | Tedesco et al. . |
| 4,644,438 | | 2/1987 | Puccinelli et al. . |
| 4,649,247 | | 3/1987 | Preuss et al. . |
| 4,650,940 | | 3/1987 | Grunert et al. . |
| 4,658,322 | | 4/1987 | Rivera . |
| 4,672,501 | | 6/1987 | Bilac et al. . |
| 4,675,481 | | 6/1987 | Markowski et al. . |
| 4,682,264 | | 7/1987 | Demeyer . |
| 4,689,712 | | 8/1987 | Demeyer . |
| 4,694,373 | | 9/1987 | Demeyer . |
| 4,710,845 | | 12/1987 | Demeyer . |
| 4,717,985 | | 1/1988 | Demeyer . |
| 4,733,211 | | 3/1988 | Castonguay et al. . |
| 4,733,321 | | 3/1988 | Lindeperg . |
| 4,764,650 | | 8/1988 | Bur et al. . |
| 4,768,007 | | 8/1988 | Mertz et al. . |
| 4,780,786 | | 10/1988 | Weynachter et al. . |
| 4,831,221 | | 5/1989 | Yu et al. . |
| 4,870,531 | | 9/1989 | Danek . |
| 4,883,931 | | 11/1989 | Batteux et al. . |
| 4,884,047 | | 11/1989 | Baginski et al. . |
| 4,884,164 | | 11/1989 | Dziura et al. . |
| 4,900,882 | | 2/1990 | Bernard et al. . |
| 4,910,485 | | 3/1990 | Bolongeat-Mobleu et al. . |
| 4,914,541 | | 4/1990 | Tripodi et al. . |
| 4,916,420 | | 4/1990 | Bartolo et al. . |
| 4,916,421 | | 4/1990 | Pardini et al. . |
| 4,926,282 | | 5/1990 | McGhie . |
| 4,928,080 | | 5/1990 | Jacobs et al. . |
| 4,935,590 | | 6/1990 | Malkin et al. . |
| 4,937,706 | | 6/1990 | Schueller et al. . |
| 4,939,492 | | 7/1990 | Raso et al. . |
| 4,943,691 | | 7/1990 | Mertz et al. . |
| 4,943,888 | | 7/1990 | Jacoh et al. . |
| 4,950,855 | | 8/1990 | Bolonegeat-Mobleu et al. . |
| 4,951,019 | | 8/1990 | Gula . |
| 4,952,897 | | 8/1990 | Barnel et al. . |
| 4,958,135 | | 9/1990 | Baginski et al. . |
| 4,965,543 | | 10/1990 | Batteux . |
| 4,983,788 | | 1/1991 | Pardini . |
| 5,001,313 | | 3/1991 | Leclerq et al. . |
| 5,004,878 | | 4/1991 | Seymour et al. . |
| 5,029,301 | | 7/1991 | Nebon et al. . |
| 5,030,804 | | 7/1991 | Abri . |
| 5,057,655 | | 10/1991 | Kersusan et al. . |
| 5,077,627 | | 12/1991 | Fraisse . |
| 5,083,081 | | 1/1992 | Barrault et al. . |
| 5,095,183 | | 3/1992 | Raphard et al. . |
| 5,103,198 | | 4/1992 | Morel et al. . |
| 5,115,371 | | 5/1992 | Tripodi . |
| 5,120,921 | | 6/1992 | DiMarco et al. . |
| 5,132,865 | | 7/1992 | Mertz et al. . |
| 5,138,121 | | 8/1992 | Streich et al. . |
| 5,140,115 | | 8/1992 | Morris . |
| 5,153,802 | | 10/1992 | Mertz et al. . |
| 5,155,315 | | 10/1992 | Malkin et al. . |
| 5,166,483 | | 11/1992 | Kersusan et al. . |
| 5,172,087 | | 12/1992 | Castonguay et al. . |
| 5,178,504 | | 1/1993 | Falchi . |
| 5,184,717 | | 2/1993 | Chou et al. . |
| 5,187,339 | | 2/1993 | Lissandrin . |
| 5,196,817 | | 3/1993 | Jacobs et al. . |
| 5,198,956 | | 3/1993 | Dvorak . |
| 5,200,724 | | 4/1993 | Gula et al. . |
| 5,210,385 | | 5/1993 | Morel et al. . |
| 5,239,150 | | 8/1993 | Bolongeat-Mobleu et al. . |
| 5,241,289 | | 8/1993 | Markowski et al. . |
| 5,260,533 | | 11/1993 | Livesey et al. . |
| 5,262,744 | | 11/1993 | Arnold et al. . |
| 5,278,531 | | 1/1994 | Link et al. . |
| 5,280,144 | | 1/1994 | Bolongeat-Mobleu et al. . |
| 5,281,776 | | 1/1994 | Morel et al. . |
| 5,296,660 | | 3/1994 | Morel et al. . |
| 5,296,664 | | 3/1994 | Crookston et al. . |
| 5,298,874 | | 3/1994 | Morel et al. . |
| 5,300,907 | | 4/1994 | Nereau et al. . |
| 5,304,761 | | 4/1994 | Rosen et al. . |
| 5,310,971 | | 5/1994 | Vial et al. . |
| 5,313,180 | | 5/1994 | Vial et al. . |
| 5,317,471 | | 5/1994 | Izoard et al. . |
| 5,331,500 | | 7/1994 | Corcoles et al. . |
| 5,334,808 | | 8/1994 | Bur et al. . |
| 5,341,191 | | 8/1994 | Crookston et al. . |
| 5,347,096 | | 9/1994 | Bolongeat-Mobleu et al. . |
| 5,347,097 | | 9/1994 | Bolongeat-Mobleu et al. . |
| 5,350,892 | | 9/1994 | Rozier . |
| 5,357,066 | | 10/1994 | Morel et al. . |
| 5,357,068 | | 10/1994 | Rozier . |

| | | | | |
|---|---|---|---|---|
| 5,357,394 | | 10/1994 | Piney . | |
| 5,361,052 | | 11/1994 | Ferullo et al. . | |
| 5,373,130 | | 12/1994 | Barrault et al. . | |
| 5,379,013 | | 1/1995 | Coudert . | |
| 5,424,701 | | 6/1995 | Castonguary et al. . | |
| 5,438,176 | | 8/1995 | Bonnardel et al. . | |
| 5,440,088 | | 8/1995 | Coudert et al. . | |
| 5,449,871 | | 9/1995 | Batteux et al. . | |
| 5,450,048 | | 9/1995 | Leger et al. . | |
| 5,451,729 | | 9/1995 | Onderka et al. . | |
| 5,457,295 | | 10/1995 | Tanibe et al. . | |
| 5,467,069 | | 11/1995 | Payet-Burin et al. . | |
| 5,469,121 | | 11/1995 | Payet-Burin . | |
| 5,475,558 | | 12/1995 | Barjonnet et al. . | |
| 5,477,016 | | 12/1995 | Baginski et al. . | |
| 5,479,143 | | 12/1995 | Payet-Burin . | |
| 5,483,212 | | 1/1996 | Lankuttis et al. . | |
| 5,485,343 | | 1/1996 | Santos et al. . | |
| 5,493,083 | | 2/1996 | Olivier . | |
| 5,493,092 | * | 2/1996 | Rowe | 218/156 |
| 5,504,284 | | 4/1996 | Lazareth et al. . | |
| 5,504,290 | | 4/1996 | Baginski et al. . | |
| 5,510,761 | | 4/1996 | Boder et al. . | |
| 5,512,720 | | 4/1996 | Coudert et al. . | |
| 5,515,018 | | 5/1996 | DiMarco et al. . | |
| 5,519,561 | | 5/1996 | Mrenna et al. . | |
| 5,534,674 | | 7/1996 | Steffens . | |
| 5,534,832 | | 7/1996 | Duchemin et al. . | |
| 5,534,835 | | 7/1996 | McColloch et al. . | |
| 5,534,840 | | 7/1996 | Cuingnet . | |
| 5,539,168 | | 7/1996 | Linzenich . | |
| 5,543,595 | | 8/1996 | Mader et al. . | |
| 5,552,755 | | 9/1996 | Fello et al. . | |
| 5,581,219 | | 12/1996 | Nozawa et al. . | |
| 5,604,656 | | 2/1997 | Derrick et al. . | |
| 5,608,367 | | 3/1997 | Zoller et al. . | |
| 5,753,878 | | 5/1998 | Doughty et al. . | |
| 5,767,440 | | 6/1998 | Byron et al. . | |
| 5,784,233 | | 7/1998 | Bastard et al. . | |
| 5,862,596 | | 1/1999 | Chung . | |
| 6,037,555 | * | 3/2000 | Castonguay et al. | 218/157 |

FOREIGN PATENT DOCUMENTS

| | | |
|---|---|---|
| 30 47 360 | 6/1982 | (DE) . |
| 38 02 184 | 8/1989 | (DE) . |
| 38 43 277 | 6/1990 | (DE) . |
| 44 19 240 | 1/1995 | (DE) . |
| 0 061 092 | 9/1982 | (EP) . |
| 0 064 906 | 11/1982 | (EP) . |
| 0 066 486 | 12/1982 | (EP) . |
| 0 076 719 | 4/1983 | (EP) . |
| 0 117 094 | 8/1984 | (EP) . |
| 0 140 761 | 5/1985 | (EP) . |
| 0 174 904 | 3/1986 | (EP) . |
| 0 196 241 | 10/1986 | (EP) . |
| 0 224 396 | 6/1987 | (EP) . |
| 0 235 479 | 9/1987 | (EP) . |
| 0 239 460 | 9/1987 | (EP) . |
| 0 258 090 | 3/1988 | (EP) . |
| 0 264 313 | 4/1988 | (EP) . |
| 0 264 314 | 4/1988 | (EP) . |
| 0 283 189 | 9/1988 | (EP) . |
| 0 283 358 | 9/1988 | (EP) . |
| 0 291 374 | 11/1988 | (EP) . |
| 0 295 155 | 12/1988 | (EP) . |
| 0 295 158 | 12/1988 | (EP) . |
| 0 309 923 | 4/1989 | (EP) . |
| 0 313 106 | 4/1989 | (EP) . |
| 0 313 422 | 4/1989 | (EP) . |
| 0 314 540 | 5/1989 | (EP) . |
| 0 331 586 | 9/1989 | (EP) . |
| 0 337 900 | 10/1989 | (EP) . |
| 0 342 133 | 11/1989 | (EP) . |
| 0 367 690 | 5/1990 | (EP) . |
| 0 371 887 | 6/1990 | (EP) . |
| 0 375 568 | 6/1990 | (EP) . |
| 0 394 144 | 10/1990 | (EP) . |
| 0 394 922 | 10/1990 | (EP) . |
| 0 399 282 | 11/1990 | (EP) . |
| 0 407 310 | 1/1991 | (EP) . |
| 0 452 230 | 10/1991 | (EP) . |
| 0 555 158 | 8/1993 | (EP) . |
| 0 567 416 | 10/1993 | (EP) . |
| 0 595 730 | 5/1994 | (EP) . |
| 0 619 591 | 10/1994 | (EP) . |
| 0 665 569 | 8/1995 | (EP) . |
| 0 700 140 | 3/1996 | (EP) . |
| 2 410 353 | 6/1979 | (FR) . |
| 2 512 582 | 3/1983 | (FR) . |
| 2 553 943 | 4/1985 | (FR) . |
| 2 592 998 | 7/1987 | (FR) . |
| 2 682 531 | 4/1993 | (FR) . |
| 2 697 670 | 5/1994 | (FR) . |
| 2 699 324 | 6/1994 | (FR) . |
| 2 714 771 | 7/1995 | (FR) . |
| 2 233 155 | 1/1991 | (GB) . |
| 92/00598 | 1/1992 | (WO) . |
| 92/05649 | 4/1992 | (WO) . |
| 94/00901 | 1/1994 | (WO) . |

* cited by examiner

BOTTOM VENTED CIRCUIT BREAKER CAPABLE OF TOP DOWN ASSEMBLY ONTO EQUIPMENT

BACKGROUND OF THE INVENTION

The present invention relates generally to molded case circuit breakers. More specifically, the present invention relates a bottom vented circuit breaker capable of top down assembly onto equipment.

Conventional circuit breakers include a breaker casing with one or more pairs of separable contacts disposed therein. Typically, each pole or phase of the breaker employs a single contact pair comprising one fixed and one movable contact. The fixed contact is electrically connected to a breaker connection lug extending within an access opening formed on the line side of the case. The movable contact is electrically connected to a breaker connection lug extending within an access opening formed on the load side of the case. The breaker connection lugs are electrically connected to equipment connection lugs extending within the access openings and forming part of the protected circuit. The access openings allow the assembled circuit breaker to be installed in a top-down manner, onto the equipment connection lugs, with the equipment connection lugs passing through the access openings as the breaker is lowered onto the equipment.

In all circuit breakers, the separation of the breaker contacts due to a short circuit causes an electrical arc to form between the separating contacts. The arc causes the formation of relatively high-pressure gases as well as ionization of air molecules within the circuit breaker. These high-pressure gases can cause damage to the breaker casing. The gases, therefore, must be vented from the circuit breaker enclosure. In addition, a phase-to-phase fault can occur if the arc gases from different phases are allowed to mix, and a phase-to-ground fault can occur if the gases contact the grounded enclosure. To avoid a phase-to-phase or phase-to-ground fault, gases vented from different phases must be kept separate from each other and away from the grounded enclosure until the ionization has dissipated.

In a conventional circuit breaker, when an overcurrent condition is present in the protected circuit, the movable contact moves upward under the force of an operating mechanism mechanically attached thereto. This action generates arc gases above the fixed contact and its associated breaker connection lug. These gases are propelled towards the top corner of the breaker. Thus, the breaker case is designed with an arc gas vent located near the top corner, to vent the arc gases to atmosphere. Typically, the arc gas vent is located on the line side of the breaker case, above the breaker connection lug. Because the arc gas vent is located near the top of the case, above the breaker connection lug, there is no interference between the arc gas vent and the access opening, which is located beneath the breaker connection lug.

However, many modern molded case circuit breakers employ a contact arrangement where arc gases are frowned beneath the equipment and breaker connection lugs. A rotary contact arrangement is an example of such a contact arrangement. In rotary contact breakers, each pole or phase employs two sets of contacts: two fixed contacts that are fixed relative to the breaker case, and two movable contacts that rotate about a common axis generally perpendicular to the current path from the line side to the load side of the circuit breaker. When the movable and fixed contacts separate, the load-side movable contact moves downward, away from the load-side fixed contact. This action generates arc gases beneath the load-side lugs, and propels the gases towards the bottom corner of the breaker casing. Thus, it is desirable for the arc gas vent to be located at the bottom of the load side of the breaker casing. Unfortunately, such a location would interfere with the access openings and, therefore, the ability to install the breaker in a top-down manner.

BRIEF SUMMARY OF THE INVENTION

In an exemplary embodiment of the invention, a bottom vented circuit breaker capable of top-down assembly onto equipment includes a circuit breaker cassette including a pair of separable contacts, wherein one of the pair of separable contacts is electrically connected to a breaker connection lug. An equipment connection lug of a first width extends from a protected circuit for electrically connecting to the breaker connection lug. A molded base comprises a bottom wall and side walls forming an interior cavity adapted to receive the breaker cassette. A pair of arc gas ducts are attached to the molded base below the breaker connection lug for receiving arc gas generated by the separable contacts. The first and second arc gas ducts are substantially parallel to each other and are separated by a predetermined distance greater than the predetermined width of the equipment connection lug for allowing the equipment connection lug to pass therebetween.

BRIEF DESCRIPTION OF THE DRAWINGS

The present invention will now be described, by way of example only, with reference to the accompanying drawing in which.

DETAILED DESCRIPTION OF THE INVENTION

Figure 1:
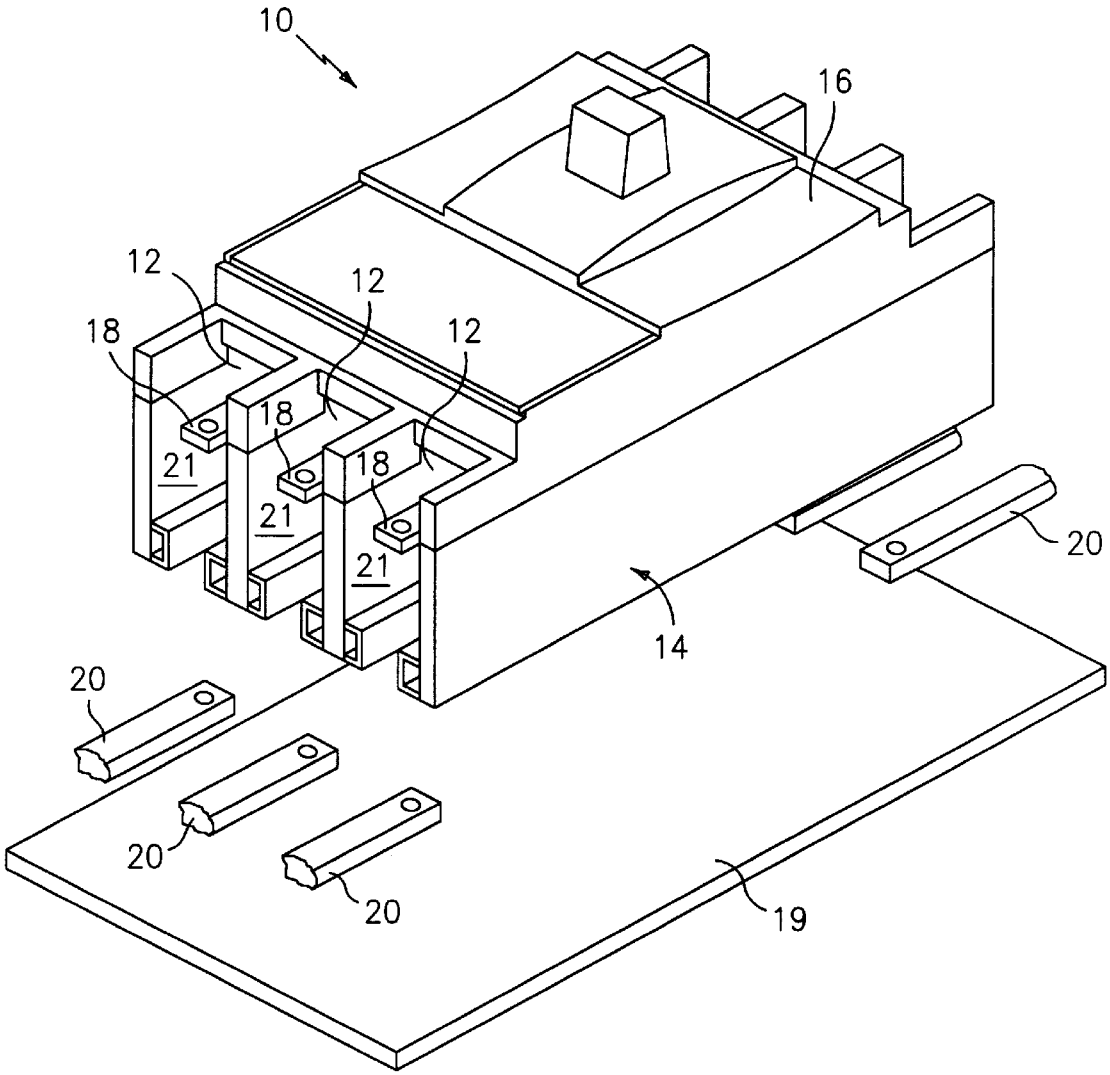
FIG. 1 is a perspective view of a circuit breaker assembly with respect to equipment connection lugs in accordance with the present invention.

Referring to FIG. 1, a molded case circuit breaker capable of top-down assembly onto equipment, generally shown at 10, includes a plurality of breaker cassettes 12 disposed in a base 14, with a cover 16 mounted upon the base 14. Breaker cassettes 12 employ a rotary contact arrangement. Breaker cassettes 12 include breaker connection lugs 18 extending therefrom for electrically connecting to equipment connection lugs 20 extending from a protected circuit (not shown). Breaker assembly 10 is installed downward onto equipment connection lugs 20 and insulating pad 19, with equipment connection lugs 20 passing through access openings 21 formed in base 14.

Figure 2:
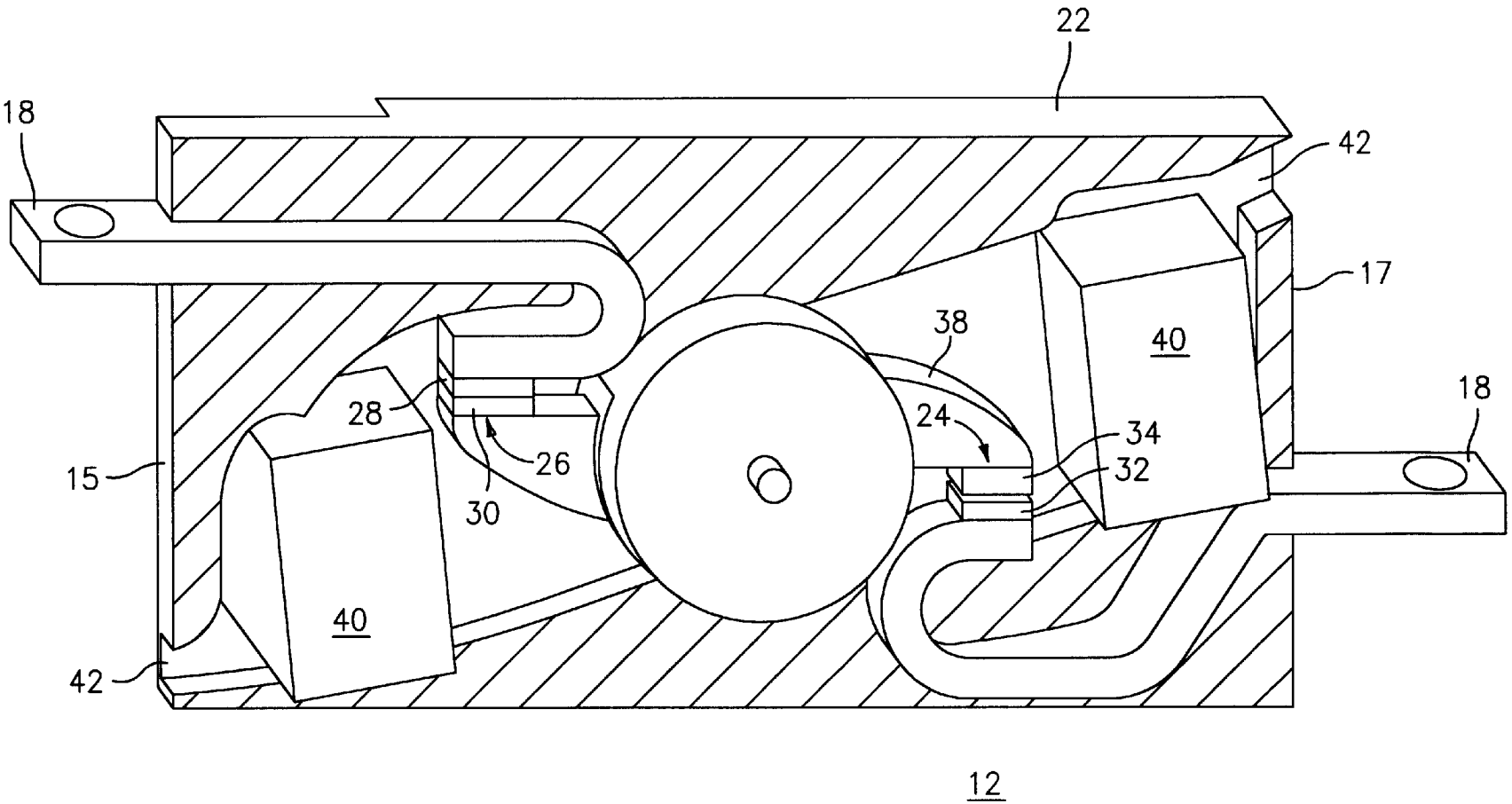
FIG. 2 is a cross sectional view of a rotary contact breaker cassette arrangement used in the circuit breaker assembly of FIG. 1.

Referring to FIG. 2, one of the breaker cassettes 12 is generally shown. Breaker cassette 12 is similar to that described in commonly assigned U.S. patent application Ser. No. 09/087,038, filed May 29, 1998 which is herein incorporated by reference in its entirety. Breaker cassette 12 comprises an insulative case 22 inside which there are two sets of separable contacts 24, 26. Each set of separable contacts comprises one fixed contact 28, 32 and one movable contact 30, 34. Fixed contact 32 is electrically connected to a breaker connection lug 18 on a line side 17 of the breaker cassette 12 and fixed contact 28 is electrically connected to the breaker connection lug 18 on a load side 15 of the breaker cassette 12. Movable contacts 30, 34 are electrically connected to each other and are both mounted on a contact bridge 38 which is pivotally mounted within the insulative case 22. When contact bridge 38 is in its closed position, a current path is created between the breaker connection lug 18 on the line side 17, fixed contact 32, movable contact 34, movable contact 30, fixed contact 28, and breaker connection lug 18 on the load side 15. Line side 17 and load side 15 define connection sides of the cassette 12 because it is these sides through which the breaker connection lugs 18 extend to connect with equipment connection lugs 20. When contact bridge 38 is in its open position, the contact pairs 24, 26 are separated and current flow through breaker cassette 12 is stopped. A conventional operating mechanism (not shown) is operatively connected to contact bridge 38. A conventional trip unit (not shown) is operatively connected to the breaker connection lug 18 on the load side 15.

As is known in the art, the trip unit samples current flowing through contacts 24, 26 and initiates a trip event if overcurrent is detected. During a trip event, the trip unit actuates the operating mechanism which moves the contact bridge 38 to its open position causing contacts 24, 26 to separate. The separation of the breaker contacts 24, 26 during a trip event causes an electrical arc to form between the separating contacts 24, 26. The arc causes the formation of relatively high-pressure arc gases as well as ionization of air molecules within breaker cassette 12.

Breaker cassette 12 further includes arc chutes 40 disposed in the line side 17 and load side 15 of insulative case 22. Arc chutes 40 are in fluid communication with the area immediately surrounding an associated pair of contacts 24, 26. Arc vents 42 are disposed through the insulative case 22 and are in fluid communication with an associated arc chute 40. Upon the separation of the contacts 24, 26 during a trip event, the arc that occurs between contacts 24, 26 is extinguished within the arc chute 40. The gases that are generated by the arc pass through the arc chute 40 and exit the breaker cassette 12 via vents 42 in the insulative case 22.

Figure 3:
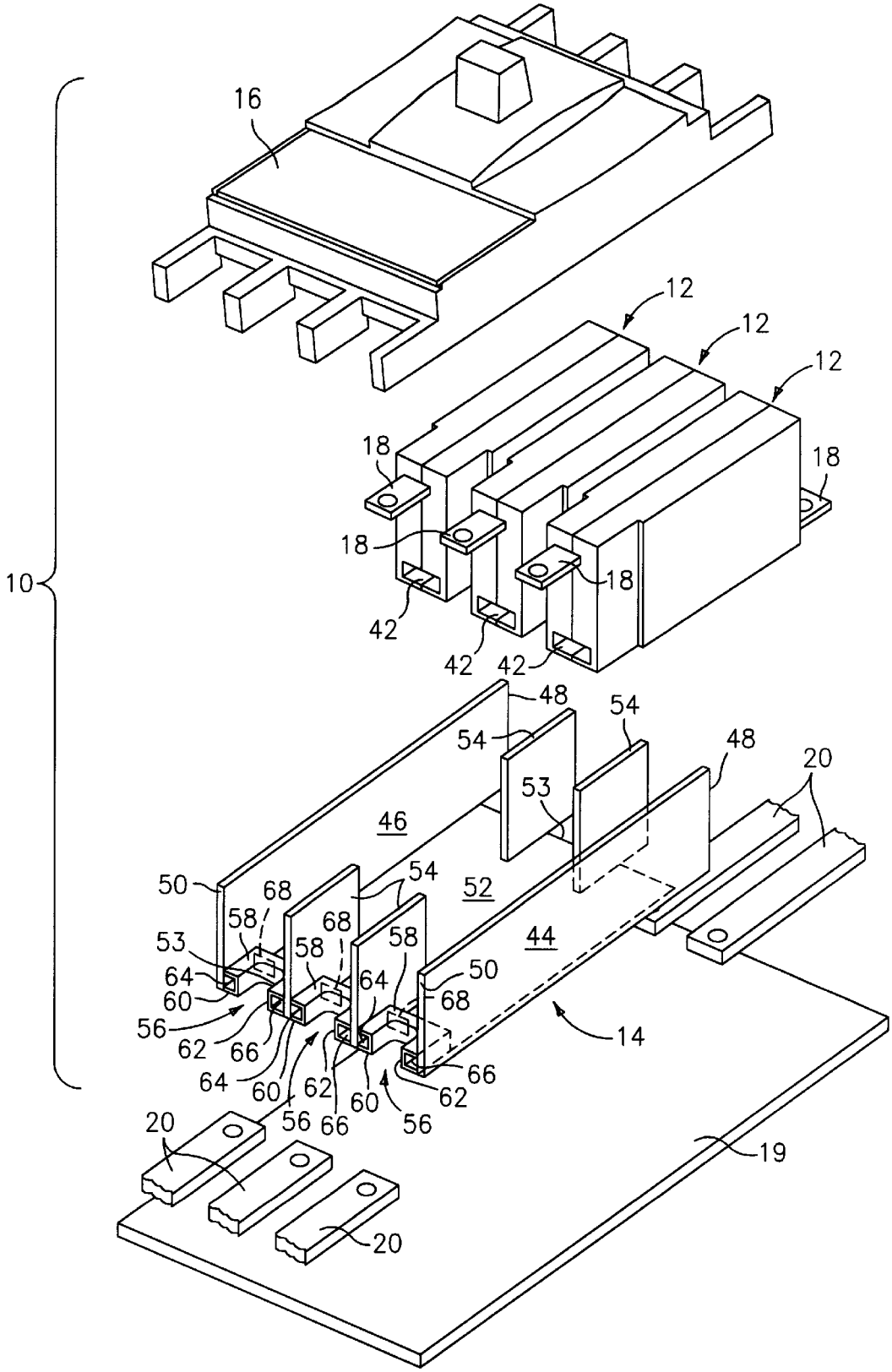
FIG. 3 is an exploded perspective view of the circuit breaker assembly and equipment connection lugs of FIG. 1.

An exploded perspective view of circuit breaker assembly 10 is shown in FIG. 3. As seen in FIG. 3, base 14 includes side walls 44 and 46 extending between line and load sides 48, 50 of base 14, and a bottom wall 52 extending between side walls 44, 46 and substantially between line and load sides 48, 50. Bottom wall 52 includes free edges 53 proximate the line and load sides 48, 50 of the base 14. The distance between free edges 53 and line and load sides 48, 50 is greater than the distance that equipment connection lugs 20 extend within base 14 when breaker assembly 12 is installed downward onto equipment connection lugs 20, thereby allowing equipment connection lugs 20 to pass unimpeded into each access opening 21. Bottom wall 52 and side walls 44, 46 define an interior cavity adapted to receive and support a plurality of breaker cassettes 12.

Extending from the bottom wall 52 proximate line and load sides 48, 50 are spacers 54. Spacers 54 and side walls 44, 46 thus each form a wall segment within the base 14. Preferably for this embodiment, two spacers 54 are provided at equal intervals between side walls 44, 46 at both the line and load sides 48, 50 to divide the space between the side walls 44, 46 into three equal segments. Each segment is adapted to accept one cassette 12. It should be noted that more spacers 54 could be used with a greater spacing between side walls 44, 46 to create more segments for additional cassettes 12 in the circuit breaker 10 if desired. Conversely, one spacer 54 could be used with less spacing between side walls 44, 46 to create a breaker unit with two cassettes 12 or no spacers could be used with less spacing between side walls 44, 46 to create a breaker unit 10 with one cassette 12.

Base 14 further includes a plurality of discrete arc gas vent structures 56 extending from the bottom wall 52 within each segment. Each arc gas vent structure 56 comprises an arc gas manifold 58 in fluid communication with arc gas ducts 60, 62. Each manifold 58 extends upwards from bottom wall 52 and between adjoining spacers 54 (for the center segment) or between adjoining spacer 54 and adjoining side wall 44 or 46 (for the side segments). Ducts 60, 62 extend substantially parallel to each other and outward from manifold 58 along spacers 54 or side walls 44, 46, culminating at exit ports 64, 66. Manifold 58 includes entrance port 68 disposed through a wall thereof distal to ducts 60, 62. Entrance port 68 aligns with arc vent 42 when breaker cassette 12 is disposed in base 14. Arc gas flow from the arc vent 42 of cassette 12 enters manifold 58 via entrance port 68. Within manifold 58 arc gas flow is bifurcated to ducts 60, 62. The exhaust gas passes through ducts 60, 62 and exhausts to atmosphere at exit ports 64, 66. Preferably, side walls 44, 46, spacers 54, manifolds 58, and ducts 60, 62 are integrally molded from an insulative material.

Insulating pad 19 is disposed between base 14 and a grounded mounting platform (not shown). Insulating pad 19 extends outward from the periphery of base 14 to shield the mounting platform from arc gases venting from the base to avoid a phase-to-ground fault. Cover 16 fits flush to the side walls 44, 46 of base 14 and flush with individual spacers 54.

Figure 4:
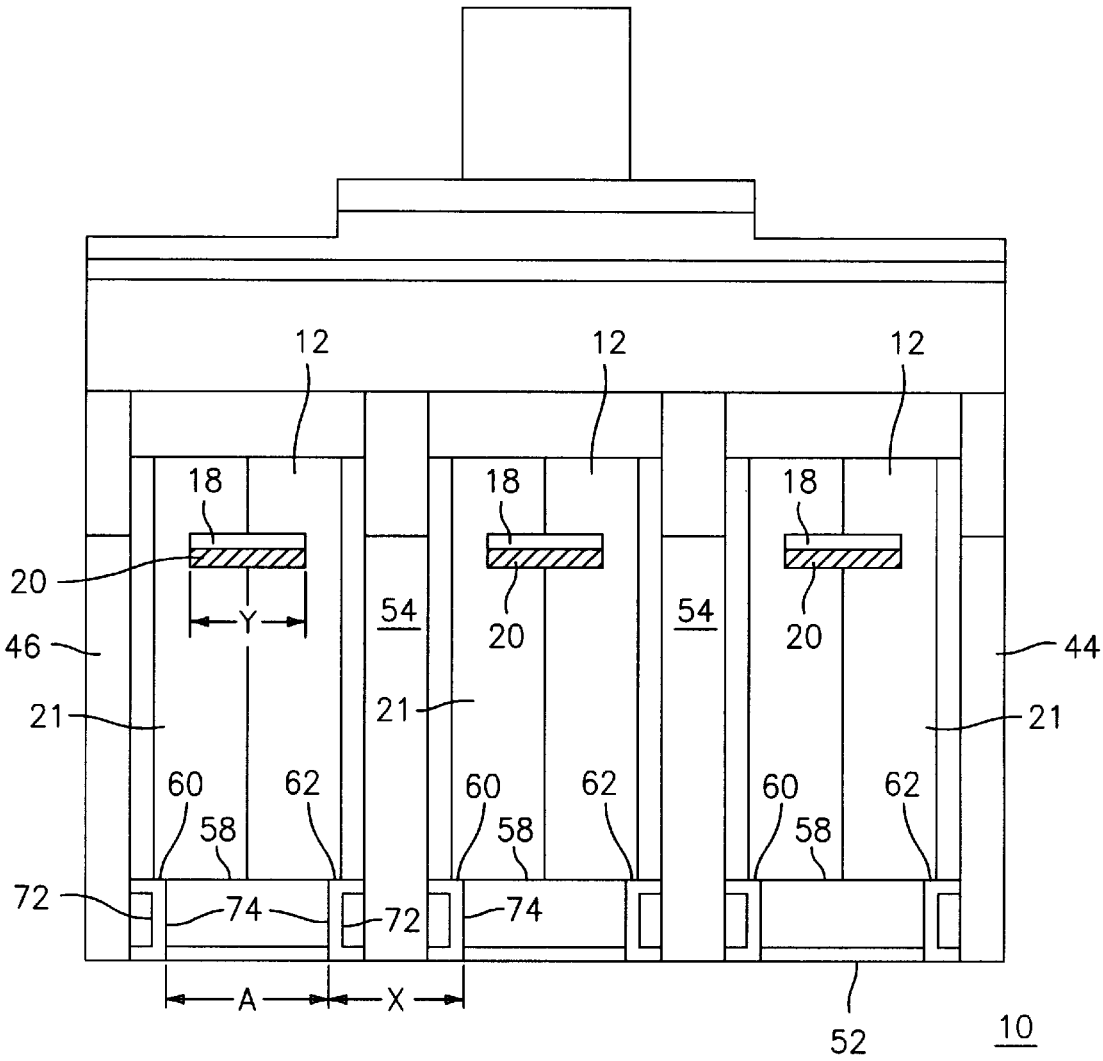
FIG. 4 is a load side elevation view of the circuit breaker assembly of FIG. 1 connected to equipment connection lugs.

As is shown by the load side elevation view of circuit breaker assembly in FIG. 4, cassettes 12 are disposed in the segments defined between spacers 54 and between spacers 54 and side walls 44, 46. Breaker connection lug 18 extends from cassette 12 and is electrically connected to equipment connection lug 20. Ducts 60, 62 extend from spacers 54 and side walls 44, 46 and include internal and external surfaces 72, 74. Internal surface 72 provides a pathway for arc gases received from cassette 12 via manifold 58. External surface 74 of ducts 60, 62 within each segment are separated by a minimum distance "A" forming access opening 21 in conjunction with spacers 54 (for the center segment) and spacers 54 and side walls 44, 46 (for the side segments). The minimum distance "A" between ducts 60, 62 within each segment is greater than a width "Y" of equipment connection lug 20, allowing equipment connection lug 20 to pass between ducts 60, 62. This feature allows breaker assembly 10 to be installed in a top-down manner onto previously installed equipment connection lugs 20.

As is also shown in FIG. 4, the external surfaces 74 of ducts 60, 62 extending from each spacer 54 are separated by a maximum distance "X". The maximum distance "X" is less than or equal to the width "A" of lug passage to limit the spacing between side walls 44, 46 and the overall width of breaker 10.

The breaker assembly 10 of the above-described invention provides arc gas venting near the bottom of the breaker, below the equipment and breaker connection lugs 18, 20, while allowing the breaker 10 to be installed in a top-down manner onto previously installed equipment connection lugs 20. The above-described invention provides arc venting of sufficient volume to prevent damage to the cassette 12 or casing 14, while keeping gases of the different phases separate from each other and away from the grounded enclosure until the ionization has dissipated.

Figure 5:
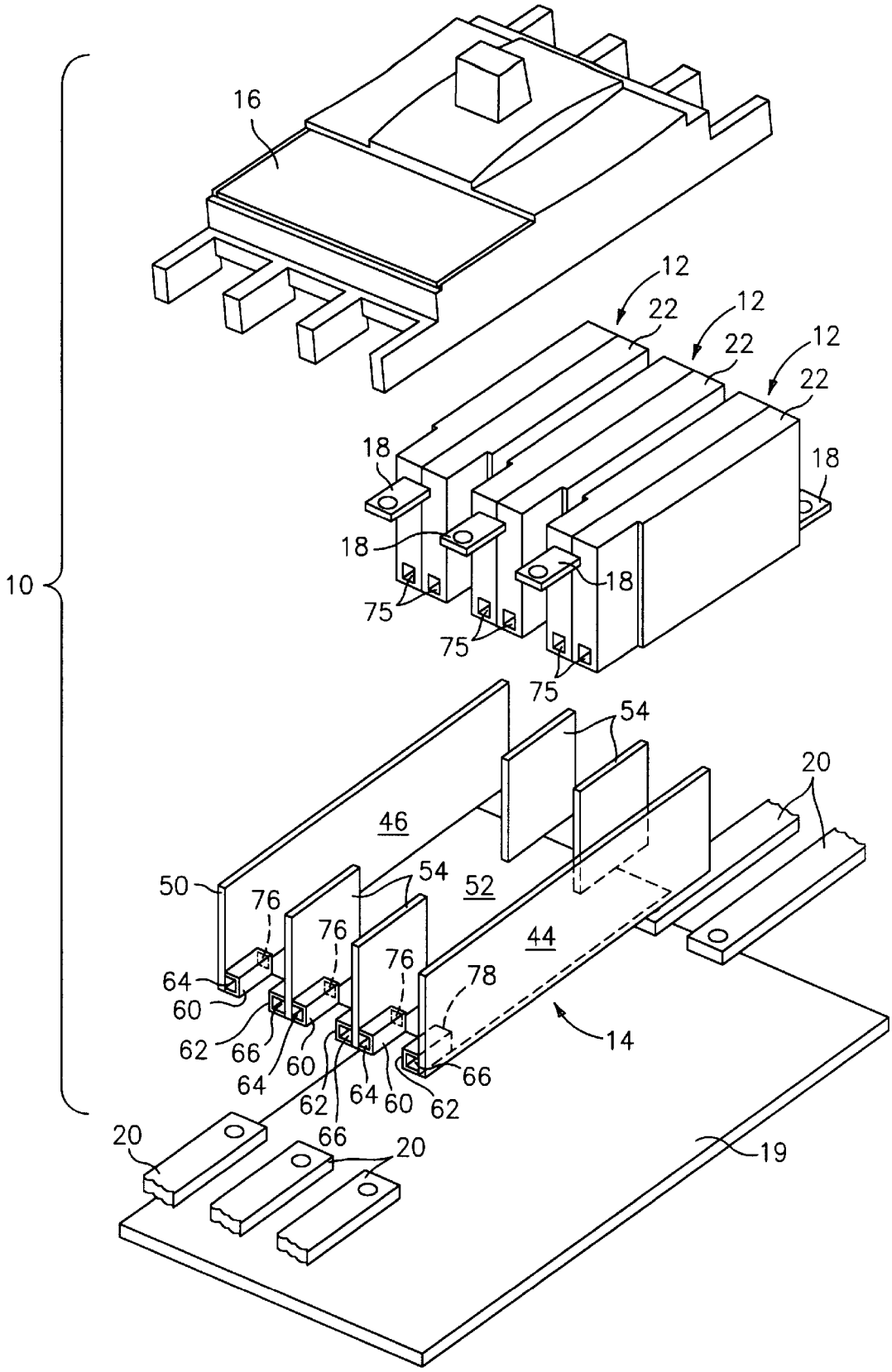
FIG. 5 is an exploded perspective view of a circuit breaker assembly in accordance with an alternate embodiment of the present invention.

An alternate embodiment is shown in FIG. 5. The alternate embodiment is substantially similar to the embodiment described above, with like features numbered alike and differences described below. In FIG. 5 , breaker cassette 12 includes two arc gas vents 75 disposed through insulative casing 22. Each segment of base 14 includes a discrete arc gas vent structure comprising a pair of ducts 60, 62 extending from the load side 50 of bottom wall 52 along adjoining spacers 54 (for the center segment) or adjoining spacer 54 and side wall 44 or 46 (for side segments). Each duct 60, 62 includes an entrance port 76, 78 and an exit port 64, 66. Entrance port 76, 78 aligns with arc gas vent 75 when breaker cassette 12 is disposed in base 14. Arc gas generated within breaker cassette 12 exits breaker cassette 12 via arc gas vents 75. Arc gas flow from each arc gas vent 75 enters its associated duct 60, 62 via entrance port 76, 78. Arc gas flow passes through duct 60, 62 and exhausts to atmosphere at exit ports 64, 66.

It will be understood that a person skilled in the art may make modifications to the preferred embodiment shown herein within the scope and intent of the claims. While the present invention has been described as carried out in a specific embodiment thereof, it is not intended to be limited thereby but is intended to cover the invention broadly within the scope and spirit of the claims.

What is claimed is:

1. A molded case circuit breaker comprising:

a cover;

a base having a first wall segment, a second wall segment, and a bottom wall;

a first cassette positioned between the first and second wall segments and upon the bottom wall of the base, the first cassette having a first connection side accessible between the first and second wall segments, the first connection side having a first arc vent adjacent the bottom wall of the base and a first breaker connection lug adjacent the cover;

a first access opening formed by the first and second wall segments and the first connection side, the first breaker connection lug extending within the first access opening;

a first pair of separable contacts arranged within said first cassette, one of said first pair of separable contacts being electrically connected to said first breaker connection lug; and first and second arc gas ducts disposed adjacent said bottom wall and within said first access opening for receiving arc gas from the first arc vent generated by separation of said first pair of separable contacts during a trip event, said first arc duct abutting said first wall segment and said second arc duct abutting said second wall segment, said first and second arc gas ducts being separated by a first distance greater than a width of a first equipment connection lug extending from a protected circuit to allow said first and second arc gas ducts to pass by the first equipment connection lug when the circuit breaker is being installed onto the protected circuit, the first breaker connection lug overlying the first equipment connection lug in an installed circuit breaker for electrically connecting said first breaker connection lug to said first equipment connection lug.

2. The molded case circuit breaker of claim 1 wherein:

said base further includes a third wall segment;

a second cassette positioned between the second and third wall segments and upon the bottom wall of the base, the second cassette having a second connection side accessible between the second and third wall segments, the second connection side having a second arc vent adjacent the bottom wall of the base and a second breaker connection lug adjacent the cover;

a second access opening formed by the second and third wall segments and the second connection side, the second breaker connection lug extending within the second access opening;

a second pair of separable contacts arranged within said second cassette, one of said second pair of separable contacts being electrically connected to said second breaker connection lug;

third and fourth arc gas ducts disposed adjacent said bottom wall and within said second access opening for receiving arc gas generated by separation of said second pair of separable contacts during a trip event, said third arc duct abutting said second wall segment and said fourth arc duct abutting said third wall segment, said third and fourth arc gas ducts being separated by a second distance greater than a width of a second equipment connection lug extending from a protected circuit to allow said third and fourth arc gas ducts to pass by the second equipment connection lug when the circuit breaker is being installed onto the protected circuit, the second breaker connection lug overlying the second equipment connection lug in an installed circuit breaker for electrically connecting said second breaker connection lug to said second equipment connection lug.

3. The molded case circuit breaker of claim 1 further comprising an arc gas manifold connecting the first arc gas duct to the second arc gas duct, the arc gas manifold having an entrance port aligned with the first arc vent for receiving arc gas generated by separation of said first pair of separable contacts during a trip event and dividing the arc gas between said first and second arc gas ducts.

4. A molded case circuit breaker comprising:

a cover;

a base having a first wall segment, a second wall segment, and a bottom wall;

a first circuit breaker cassette positioned on the bottom wall of the base, the first circuit breaker cassette having a first connection side accessible between the first wall segment and second wall segment, said first circuit breaker cassette including, a first pair of separable contacts disposed within said first circuit breaker cassette, and a first breaker connection lug electrically connected to one of said first pair of separable contacts and extending from said first connection side, said first connection side further having first and second arc gas vents adjacent the bottom wall; and a first arc gas duct abutting the first wall segment and a second arc gas duct abutting the second wall segment, the first arc gas duct aligned with the first arc gas vent and the second arc gas duct aligned with the second arc gas vent for passing arc gas generated by separation of said first pair of separable contacts during a trip event from the first arc vent to the first arc duct and from the second arc vent to the second arc duct, said first and second arc gas ducts separated by a first distance, said first distance being greater than a width of a first equipment connection lug extending from a protected circuit to allow said first and second arc gas ducts to pass by the first equipment connection lug when the circuit breaker is being installed onto the protected circuit, the first breaker connection lug overlying the first equipment connection lug in an installed circuit breaker for electrically connecting said first equipment connection lug to said first breaker connection lug.

5. The molded case circuit breaker of claim 4 further including:

a third wall segment in the base;

a second circuit breaker cassette supported by said bottom wall and having a second connection side accessible between said second wall segment and said third wall segment, a second pair of separable contacts disposed within said second circuit breaker cassette, a second breaker connection lug electrically connected to one of said second pair of separable contacts and extending from said second connection side, and third and fourth arc gas vents in said second connection side adjacent said bottom wall; and a third arc gas duct abutting the second wall segment and a fourth arc gas duct abutting the third wall segment, the third arc gas duct aligned with the third arc gas vent and the fourth arc gas duct aligned with the fourth arc gas vent for passing arc gas generated by separation of said second pair of separable contacts during a trip event from the third arc gas vent to the third arc gas duct and from the fourth arc gas vent to the fourth arc gas duct, said third and fourth arc gas ducts separated by a second distance, said second distance being greater than a width of a second equipment connection lug extending from a protected circuit to allow said third and fourth arc gas ducts to pass by the second equipment connection lug when the circuit breaker is being installed onto the protected circuit, the second breaker connection lug overlying the second equipment connection lug in an installed circuit breaker for electrically connecting said second breaker connection lug to said second equipment connection lug.

6. The molded case circuit breaker of claim 1 wherein the base defines an interior cavity for supporting a single cassette, the first wall segment forming a first sidewall of the base and the second wall segment forming a second sidewall of the base.

7. The molded case circuit breaker of claim 1 wherein the base includes a first sidewall and second sidewall defining, with the bottom wall, an interior cavity for supporting multiple circuit breaker cassettes, the first wall segment forming the first sidewall of the base and the second wall segment forming a spacer between adjacent circuit breaker cassettes.

8. The molded case circuit breaker of claim 1 wherein the first cassette includes a rotary contact arrangement having a contact bridge supporting a movable contact on each end, one movable contact defining one of said first pair of separable contacts for abutting with said one of said first pair of separable contacts being electrically connected to said first breaker connection lug.

9. The molded case circuit breaker of claim 4 wherein the base defines an interior cavity for supporting a single cassette, the first wall segment forming a first sidewall of the base and the second wall segment forming a second sidewall of the base.

10. The molded case circuit breaker of claim 4 wherein the base includes a first sidewall and second sidewall defining, with the bottom wall, an interior cavity for supporting multiple circuit breaker cassettes, the first wall segment forming the first sidewall of the base and the second wall segment forming a spacer between adjacent circuit breaker cassettes.

11. The molded case circuit breaker of claim 4 wherein the first cassette includes a rotary contact arrangement having a contact bridge supporting a movable contact on each end, one movable contact defining one of said first pair of separable contacts for abutting with said one of said first pair of separable contacts being electrically connected to said first breaker connection lug.

* * * * *